US005847510A

United States Patent [19]

Goelling et al.

[11] Patent Number: 5,847,510

[45] Date of Patent: Dec. 8, 1998

[54] HIGH PRESSURE DISCHARGE BULB

[75] Inventors: Hans-Werner Goelling; Thomas Dittrich, both of Berlin; Dieter Franke, Munich, all of Germany

[73] Assignee: Patent-Treuhand-Gesellschaft Fuer Elektrische Gluehlampen MBH, Munich, Germany

[21] Appl. No.: 905,981

[22] Filed: Aug. 5, 1997

[30] Foreign Application Priority Data

| | | | |
|---|---|---|---|
| Aug. 21, 1996 | [DE] | Germany | 196 33 732.1 |
| Mar. 26, 1997 | [DE] | Germany | 197 12 776.2 |

[51] Int. Cl.[6] ..... H01J 61/30

[52] U.S. Cl. ..... 313/623; 313/331

[58] Field of Search ..... 313/318.02, 570, 313/623, 318.07, 331

[56] References Cited

U.S. PATENT DOCUMENTS

| | | | |
|---|---|---|---|
| 3,205,395 | 9/1965 | Buchwald . | |
| 3,211,826 | 10/1965 | Holcomb et al. | 313/318.07 |
| 4,208,607 | 6/1980 | Hokkeling et al. | 313/331 |
| 4,236,045 | 11/1980 | Van Den Plas et al. | 313/331 |
| 4,677,338 | 6/1987 | Dixon et al. | 313/623 |
| 4,749,905 | 6/1988 | Mori et al. | 313/331 |
| 5,107,177 | 4/1992 | Barthelmes et al. | 313/623 |

FOREIGN PATENT DOCUMENTS

| | | |
|---|---|---|
| 0 271 140 A2 | 6/1988 | European Pat. Off. . |
| 0 397 226 A1 | 11/1990 | European Pat. Off. . |
| 0 639854 A1 | 2/1995 | European Pat. Off. . |
| 1102646 | 2/1968 | United Kingdom . |

*Primary Examiner*—Sandra O'Shea
*Assistant Examiner*—Matthew J. Gerike
*Attorney, Agent, or Firm*—William E. Meyer

[57] ABSTRACT

The invention concerns a high pressure discharge bulb. Such bulbs involve a two-sided sealed bulb with and without an outer bulb. The bulb is sealed by a pinch on at least one side. It generally has a discharge vessel made of quartz. These bulbs particularly comprise metal halide bulbs, which have a metal halide filling in addition to mercury, but they also include mercury high pressure discharge bulbs or xenon high pressure discharge bulbs. The bulbs are used preferably for optical systems, particularly larly for photo-optical purposes, for example, in head-lights, overhead projectors, and decorative lighting devices. They particularly find application in lighting systems for the stage, film and television. Typical lamp powers are 400 to 2000 W. A discharge lamp pinched on each end has pinches in which the ratio of the total width of each wide side is smaller than or equal to 2.2 times the thickness of the wide side. Tube pieces carrying the base sleeves are formed on the outer ends of the pinches.

14 Claims, 2 Drawing Sheets

HIGH PRESSURE DISCHARGE BULB

TECHNICAL FIELD

The invention relates to electric lamps and particularly to arc discharge electric lamps. More particularly the invention is concerned with an envelope structure for an arc discharge electric lamp.

BACKGROUND ART

A high pressure discharge bulb is known from U.S. Pat. No. 5,142,195, whereby the pinch seals comprised of wide and narrow sides have the typical double T shape (also called the I shape) in cross section. The total width w of the pinches (16 mm) corresponds approximately to four times the thickness d of the pinch seals (4 mm). Such a width to thickness ratio w/d of approximately 4 is generally common. At the end of the pinches remote from the base, ceramic base sleeves are attached by means of adhesive. These pinches, whose length is approximately the same as that of the discharge vessel, serve primarily for the purpose of limiting the temperature of the foil end next to the base to at most 350° C. (see also U.S. Pat. No. 5,138,227 in this regard). In order to assure a sufficient mechanical stability of these pinches, according to U.S. Pat. No. 5,142,195, braces are shaped at the attachment point of the pinch on the discharge vessel. The stability can be further improved by a special configuration of the braces.

DISCLOSURE OF THE INVENTION

An improved discharge bulb pinched on two sides has pinches (4) with a ratio of total width to thickness of the wide sides of less than or equal to 2.2. Tube pieces (13) which have base sleeves (15) are found on the outer end of the pinches.

The high pressure discharge bulb according to the invention consists of a lengthwise-extended discharge vessel with a central region, which encloses a discharge volume, and with at least one, and preferably two, pinches, which extend in diametrically opposite directions away from the central region. The pinch has two wide sides and narrow sides. In particular, the pinch is at least 18 mm long.

The length of the pinch is of the order of magnitude of the length dimension of the central region. The dimensions of the pinch are selected such that the total width of the wide side is less than or equal to 2.2 times the thickness of this wide side.

Previously, such bulbs were sealed with a cylindrical belt or neck type seal with a circular or oval cross section, which facilitated a high stability despite the long lamp shaft (longer than 18 mm). However, it is a disadvantage that these seals must be manufactured manually. Initial attempts to replace these seals by common pinches with known dimensions produced an insufficient stability of the pinches. The danger of breaking of the wide sides is considerably greater than for the narrow sides. It resulted that these pinches with width to thickness w/d ratio approximately equal to 4, which are clearly rectangular in section, have very different axial bending moments, which represent a measurement for breaking strength, for the wide and narrow sides. It was previously attempted to improve the breaking strength by a special shaping of the attachment of the rectangular pinch on the discharge vessel.

By selecting the geometry of the pinch according to the invention, the mechanical stability is decisively improved, so that now the breaking strength of the narrow side and the wide side is approximately the same, and corresponds approximately to that of a bulb with seals.

The stability of the bulb can preferably further be improved by careful selection of the thickness of the discharge vessel. The wall thickness of the discharge vessel advantageously amounts to more than 1.5 mm. Preferably, it is approximately 2 mm±0.3 mm.

In particular, the wide sides of the pinches are equipped with beaded edges in a way known in and of itself, and these edges widen the narrow sides. In this way, the stability is improved still further. Particularly good results can be obtained if the total width of the narrow sides (including the beaded edges) corresponds to approximately (in particular, precisely within at least 20%) the total width of the wide sides.

The surface of the wide sides is advantageously cross-corrugated. This creates a larger surface, which due to its high heat dissipation, additionally reduces the temperature load of the ends of the foil and, in addition to this, improves the stiffness of the seal.

Preferably the foil length amounts to approximately 60 to 70% of the length of the pinch.

The total width of the pinch reaches less than 50% of the maximum width of the central region.

In a particularly preferred form of embodiment, and also for reflector bulbs, a hollow-cylindrical tube piece is shaped on the outer pinch end. A base part can be mounted on this. For example, the outer diameter of the tube piece is adapted to the inner diameter of a cylindrical base sleeve that is set thereon. The outer diameter of the tube piece preferably corresponds to approximately the total width of the wide sides of the pinch. In this way, both parts are ideally fine tuned to each other and thus can be easily manufactured. In addition, the bulb shaft (here designed as the pinch) and base can be better centered axially than in the case of an oval seal. Also, the hollow space remaining between the shaft and the base can be well screened against the penetration of air by means of suitable materials.

Two electrodes extend from the pinches into the discharge volume. They are joined with outer current leads via metal foils, whereby the metal foils are arranged in the pinches.

It has proven favorable in several respects, if the electrodes are wrapped with small rolls of molybdenum foil, since in this way, fissures and cracks during the pinching and connection and disconnection of the bulb are prevented and the centering of the electrodes is improved. The small rolls act as a flexible layer between the electrodes and the surrounding quartz wall, and prevent an adherence of the quartz glass to the electrode. In addition, the molybdenum acts as a getter relative to the impurities in the filling. Overall, the service life of the bulb is prolonged by the small roll.

A transitional zone is preferably inserted between the central region and the pinch for further improvement of the breaking strength. This zone is approximately 1 to 4 mm long The light-emitting filling in the discharge volume preferably contains metal halides.

For the most part, the discharge vessel itself is the lamp bulb. The invention may also be applied in bulbs with a reflector or with an outer bulb.

The invention will be explained in more detail in the following on the basis of several examples of embodiment.

BEST MODE FOR CARRYING OUT THE INVENTION

Figure 1:
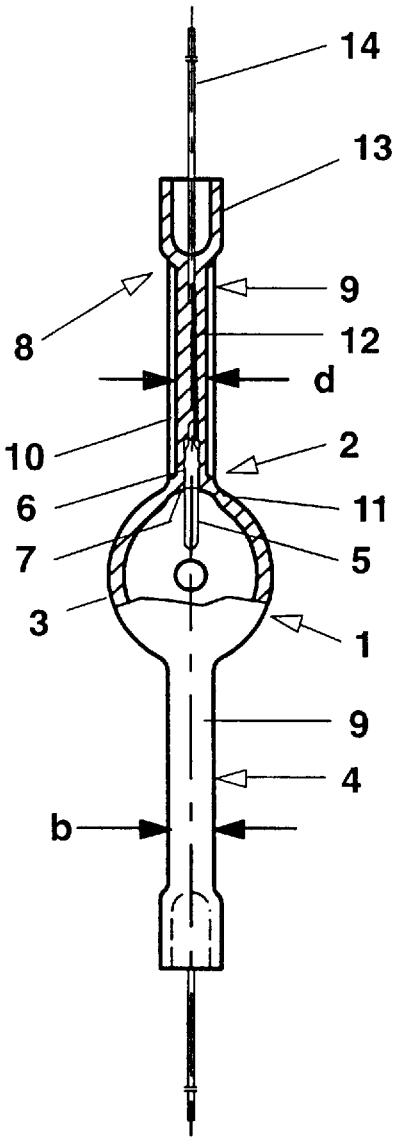
FIG. 1 shows a metal halide bulb without a base, in section and in lateral view.
Figure 2:
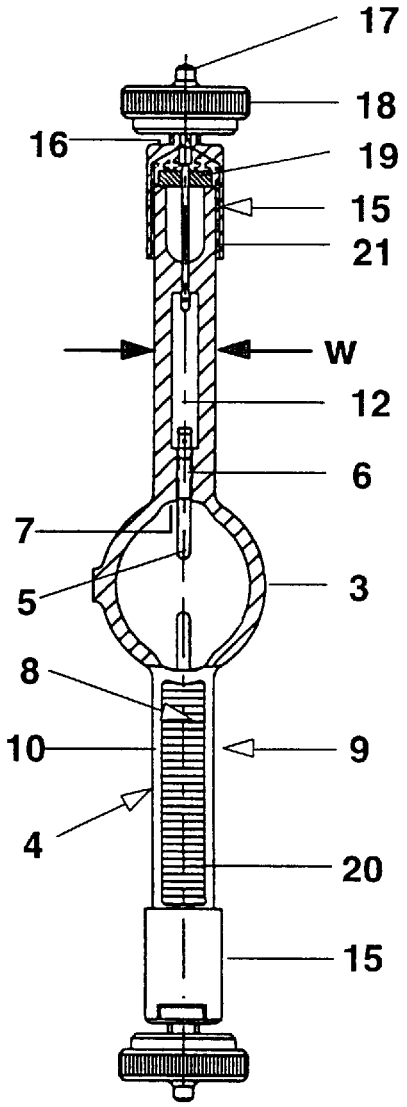
FIG. 2 shows the metal halide bulb of FIG. 1 in a lateral view that has been rotated 90°, but with a base.

In FIGS. 1 and 2, a 575-W high pressure discharge bulb 1 is shown with a length of approximately 100 mm, which does not require an outer bulb. It is designed for use in a reflector that is not shown here, particularly in an overhead projector, in which it is inserted lying crosswise. It has a discharge vessel 2, which comprises a central region 3, to which are attached two pinches 4 lying diametrically opposite one another. Isothermal discharge vessel 2 made of quartz glass, in a very good approximation, has a wall thickness of roughly 1.8 mm. The central region 3 is designed as a spherical unit with an outer diameter of approximately 22 mm, so that a discharge volume of approximately 3 $cm^3$ results. The rodshaped tungsten electrodes 5, whose tips are at a distance of 7 mm, are each held axially in pinch 4. They are each enveloped by a small molybdenum roll 6, at least in the region of the pinch. The central region has an indentation 7 in the vicinity of the electrode, and this defines the coldest place.

Pinches 4, each of which has two wide sides 8 and narrow sides 9, have a total width w of approximately 8 mm and a thickness d of approximately 4 mm, so that w/d =2.0. They have along the edges of wide sides 8 thickened beaded edges 10, so that the narrow sides including the beaded edges reach an effective width b of approximately 6 mm. Pinches 4, which are approximately 28 mm long, are connected by means of a short transitional zone 11 to central region 3. Transitional zone 11 is approximately 2 mm long. A tapering transition between the curved wall of the central region and the straight contours of the pinches are found in this zone. The radius of curvature in the region of the transition typically amounts to approximately 2 mm.

Molybdenum foils 12 with a length of 20 mm and a width of 3.5 mm are arranged approximately centrally in each of pinches 4. They are embedded in a vacuum-tight manner in the pinch. Cylindrical tube pieces 13 are shaped on the ends of the pinches away from the discharge, and these have an outer diameter of 8 mm, and an inner diameter of 5 mm. The tube pieces are each approximately 10 mm long.

Electrodes 5 are connected with outer current leads 14 via molybdenum foils 12, and these leads extend via tube pieces 13 centrally toward the outside. Current leads 14 are in contact with metal base sleeves 15 (see FIG. 2) by means of hard soldering. Base sleeves 15 are directly pushed onto glass tube pieces 13 and joined with these by means of adhesive 21. Base sleeve 15 is closed on the outside by a type of cover (reference 16). A threaded screw 17, which has a knurled nut 18, is placed in a way known in and of itself on cover 16. Advantageously a sealing medium 19 is inserted in the hollow space between tube piece 13 and cover 16; this makes difficult the oxidation of the foil. Sealing medium 19 may also be introduced into the entire hollow space in an advantageous manner. For example, ceramic paper or adhesive cement compound can be used as the sealing medium. A typical temperature on the end of the pinch is 250° C.

The surfaces of wide sides 8 of the pinches are provided with a cross-corrugation 20. They also have longitudinally extended centering knobs (not shown) at the level of the electrodes and the outer current leads.

The discharge volume contains a filling of an inert gas (argon) as an ignition gas and mercury as the primary component as well as metal halides, comprised of iodides and/or bromides of hafnium, dysprosium, gadolinium, cesium, and thallium. Overall, a color temperature of 6000 K with a color reproduction index of greater than 85 resulted with this filling.

With a supply voltage of 230 V and a lamp current of 6.7 A, an arc-drop voltage of 100 V is obtained. The discharge is arc-stabilized, whereby the electrode distance amounts to 7 mm.

Another example of embodiment is a 1200 W lamp with metal halide filling, whose structure is similar to that shown in FIGS. 1 and 2. The lamp bulb has a total length of approximately 160 mm. The dimensions of the pinches and of the other individual components are enlarged by approximately 50% in comparison to the first example of embodiment. The w/d ratio is also approximately 2.0 here.

These bulbs are essentially produced as in the above-described state of the art, whereby the pinches must be shaped correspondingly.

Figure 3:
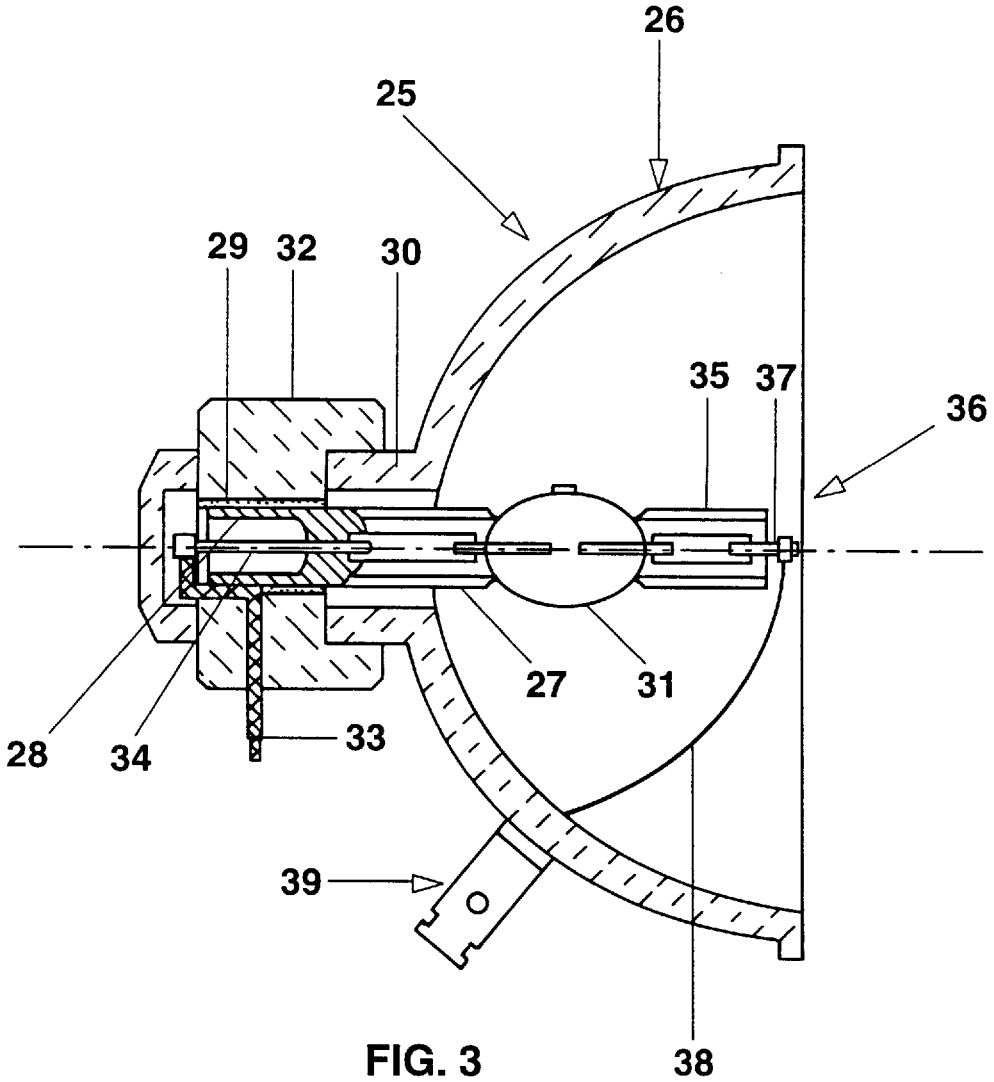
FIG. 3 shows an alternative embodiment of a reflector bulb.

An example of embodiment of a reflector bulb is shown in FIG. 3. Reflector bulb 25 sits axially in a reflector 26, in the apical region of which is found a reflector neck 30. Central region 31 of the lamp is sealed on its first end with a first pinch 27 that is approximately "square" in cross-section, and this pinch also has on its outer end an extension in the configuration of a hollow cylindrical tube piece 28. This first pinch 27 plus extension 28 sits in reflector neck 30 and is mounted there in a ceramic base part 32, which is attached at neck 30 by means of base adhesive 29. The w/d ratio is approximately 1.8 for the approximately "square" pinch.

In a second example of embodiment, the first end of the reflector bulb can be sealed instead by a seal in a way that is known in and of itself, which [seal] also has a hollow cylindrical tube piece. The advantage of the use of a square pinch when compared with a seal, however, is that clearly more space remains for the optical adjustment of the bulb in the reflector neck, since the cross-sectional surface of this pinch is smaller than in the case of a seal. Adjustment is considerably facilitated in this way.

A current lead cable 33 is introduced laterally into base part 32 and joined with outer current lead 34, which S projects out from hollow cylindrical extension 28. The second end of central region 31 of the bulb is sealed by a (second) "square" pinch 35 in each of the two examples of embodiment of a reflector bulb. This pinch is advantageously kept short enough (particularly without a tube piece), so that the end of the pinch does not project beyond reflector opening 36. In this way, a very compact and accurately adjusted reflector bulb will be produced.

The second current lead 37 projecting out from second pinch 35 is guided by means of a curved cable 38 to a separate lateral connector 39 on the reflector. While there have been shown and described what are at present considered to be the preferred embodiments of the invention, it will be apparent to those skilled in the art that various changes and modifications can be made herein without departing from the scope of the invention defined by the appended claims.

What is claimed is:

1. A high pressure discharge lamp, comprising:

a longitudinally extended discharge vessel (2) with a central region (3), which encloses a discharge volume, having an internal width and an internal axial length, and has two end regions, which extend in diametrically opposite directions, and in which at least one pinch (4) is formed, which has two wide sides (8), each having a portion generally planar in form, the two wide side portions being generally parallel one to the other and narrow sides (9) each also having a portion generally planar in form, the two narrow side portions being generally parallel one to the other;

a pair of electrodes (5), which extend into the discharge volume, at least one of which extends from the pinch and which is connected by means of a metal foil (12) to an outer current lead (14), whereby the metal foil is embedded in the pinch;

the pinch length being long relative to the central region, being at least 18 mm long, and being at least 60 percent of the length of the central region the pinch width being narrow relative to the central region, being less than 50 percent of the width of the central region a filling that emits light when subjected to an electric discharge is positioned in the discharge volume;

the dimensions of the pinch (4) are such that the least thickness between the narrow side portions, measured through the foil, is smaller than or equal to 2.2 times the least thickness between the wide side portions, measured through the foil.

2. The high pressure discharge bulb according to claim 1, further characterized in that the foil length amounts to approximately 60 to 70% of the length of the pinch.

3. The high pressure discharge bulb according to claim 1, further characterized in that total width of the pinch amounts to less than 50% of the maximum width of the central region.

4. The high pressure discharge bulb according to claim 1, further characterized in that wide sides (8) are equipped with beaded edges (10) that widen narrow sides (9).

5. The high pressure discharge bulb according to claim 1, further characterized in that the surface of the wide sides is cross-corrugated (20).

6. The high pressure discharge bulb according to claim 1, further characterized in that a cylindrical tube piece (13) is formed on the pinch end.

7. The high pressure discharge bulb according to claim 6, further characterized in that the outer diameter of tube piece (13) is adapted to the inner diameter of a base sleeve (15) placed thereon.

8. The high pressure discharge bulb according to claim 6, further characterized in that the outer diameter of the tube piece corresponds approximately to the total width of the wide side of the pinch.

9. The high pressure discharge bulb according to claim 1, further characterized in that the wall thickness of the discharge vessel (including the tube piece) amounts to approximately 2 mm.

10. The high pressure discharge bulb according to claim 1, further characterized in that the electrodes are each wrapped with small rolls (6) of molybdenum.

11. The high pressure discharge bulb according to claim 1, further characterized in that between central region (3) and pinch (4) is inserted a transitional zone (11).

12. The high pressure discharge bulb according to claim 1, further characterized in that the discharge vessel is the single lamp bulb.

13. The high pressure discharge bulb according to claim 1, further characterized in that the filling contains metal halides.

14. The high pressure discharge bulb according to claim 1, further characterized in that the total width of narrow sides (9), including the beaded edges, corresponds to approximately (particularly to within at least 20%) the total width of wide sides (8).

* * * * *